United States Patent [19]

Courtenay et al.

[11] 4,043,543

[45] Aug. 23, 1977

[54] TUNDISH WITH WEIRS

[75] Inventors: John Henry Courtenay; Martin Bernard Peter Wardell, both of Birmingham, England

[73] Assignee: Foseco Trading A.G., Chur, Switzerland

[21] Appl. No.: 693,959

[22] Filed: June 8, 1976

[30] Foreign Application Priority Data

May 19, 1976 United Kingdom ..... 20701/76

[51] Int. Cl.[2] ..... C21C 5/00

[52] U.S. Cl. ..... 266/275; 266/236

[58] Field of Search ..... 164/82, 281; 222/590–592, 607; 266/165, 236, 275, 276, 280, 283, 284

[56] References Cited

U.S. PATENT DOCUMENTS

| | | | |
|---|---|---|---|
| 3,499,587 | 3/1970 | Brock | 222/591 |
| 3,521,698 | 7/1970 | Colombo | 222/607 |
| 3,608,621 | 9/1971 | Bollig et al. | 222/591 |
| 3,887,171 | 6/1975 | Neuhaus | 165/281 |
| 3,917,110 | 11/1975 | Kiguchi | 266/280 |

FOREIGN PATENT DOCUMENTS

| | | | |
|---|---|---|---|
| 1,039,083 | 9/1958 | Germany | 222/591 |

*Primary Examiner*—Gerald A. Dost

*Attorney, Agent, or Firm*—Cushman, Darby & Cushman

[57] ABSTRACT

The invention provides a tundish comprising a casing having a floor with at least one outlet nozzle located therein and upstanding sidewalls, the casing having a permanent refractory lining, and an expendable partition of refractory heat insulating material being located adjacent one or each nozzle within the tundish and dimensioned to stand proud of the adjacent portion of the tundish floor. Generally the expendable partition is made of a material comprising a major proportion of particulate refractory, a minor proportion of fibrous material and an organic binder. The partition may comprise four walls together defining a box section or it may be an integral preformed sleeve.

10 Claims, 3 Drawing Figures

TUNDISH WITH WEIRS

This invention relates to tundishes for use in the casting of molten metals especially in the continuous casting of steel.

Tundishes are vessels interposed between a ladle and a mould to act as a constant head reservoir. Tundishes typically comprise a casing having a floor and sidewalls and have pouring nozzles located in the floor, in a so-called nozzle well for egress of the molten metal. The inside of the casing is permanently lined with a refractory brick or monolithic refractory, and the impact area of the floor, on which the stream of molten metal from the ladle falls, may also have a protective lining.

When molten metal is poured into a tundish there is a tendency for the nozzle well to be subject to considerable wear. In addition, because of the shape of the nozzle well, molten metal tends to be left in it at the end of each pour and to solidify, thus making removal of the nozzle for replacement or repair difficult. We have now found that if We partition of suitable material is located adjacent the nozzle well the above disadvantages can be reduced and certain other advantages can be obtained.

According to the invention there is provided a tundish comprising a casing having a floor with at least one outlet nozzle located therein and upstanding sidewalls, the casing having a permanent lining, and an expendable partition of refractory heat insulating material being located adjacent the or each nozzle within the tundish and dimensioned to stand pround of the adjacent portion of the tundish floor.

By the term "expendable partition" is meant a partition which in use is at least partially consumed and which must be replaced each time the tundish is emptied of molten metal. The partition is made from refractory heat insulating material of low thermal conductivity and low thermal capacity.

While the partition may be of any suitable solid construction such as a simple wall it is preferable to arrange for one or each nozzle to be surrounded by the partition. Thus, the partition may comprise four walls together defining a box section or it may be an integral preformed sleeve. The thickness of the partition is preferably of the order of 25 to 35 mm and preferably the partition extends 20 to 50 mm above the floor of the tundish.

When pouring the molten metal into a tundish which is relatively cooler than the metal, there is a tendency for the molten metal initially poured into the tundish to cool and form a thin skull on the tundish floor. In a tundish in accordance with the invention the presence of the partition tends to ensure that the thin skull is formed away from the nozzle well, and that succeeding molten metal can flow over this thin skull, and over the partition, into the nozzle. Further, the force of the molten metal as it is poured can cause extraneous matter remaining in the tundish after the tundish has been lined to pass into the nozzle. The presence of the partition tends to prevent such matter from passing into the nozzle.

The tundish may be of the kind disclosed in British Patent No. 1,364,665 in which the casing has a further inner expendable lining for the sidewalls and floor, which in use contacts the molten metal, the further lining comprising preformed slabs of refractory heat insulating material, and the impact area of the tundish is lined additionally either with highly erosion resistant material or with sacrificial material. Also, the tundish may be of the kind disclosed in co-pending, commonly assigned, Application Serial No. 693,958, filed June 8, 1976 which includes at least one expendable beam, preferably two pairs of expendable beams, of refractory heat insulating material extending between opposite sides of the tundish casing adjacent the impact area.

The partition may be made of an expendable material comprising a major proportion of particulate refractory, a minor proportion of inorganic and/or organic fibrous material and an organic binder, typically a resin binder. Preferably such a material will include (by weight) 75 to 90% refractory, up to 15% fibre and up to 10% binder, and preferably will have a density of 0.8 to 1.5 g/cm$^3$ e.g. 1 to 1.3 g/cm$^3$ and a thermal conductivity of less than 0.0007 c.g.s. units.

Suitable materials are those comprising:

Refractory Silica e.g. silica sand or silica flour, alumina, magnesia, refractory silicates such as aluminum or magnesium silicates and/or carbonaceous materials such as graphite or crushed electrode scrap.

Binder: Starch, phenol-formaldehyde resin and/or urea-formaldehyde resin.

The invention includes a method of continuously casting a metal, preferably steel, in which a tundish according to the present invention is used.

Embodiments of the invention will now be described by way of example with reference to the accompanying diagrammatic drawings in which.

Figure 1:
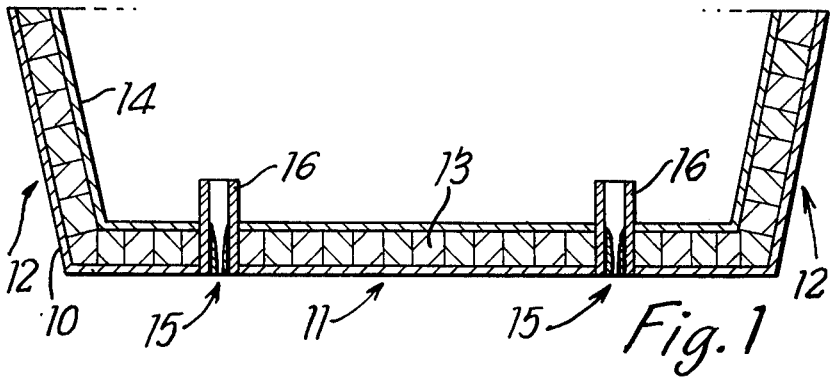
FIG. 1 is a sectional view of a tundish.

The tundish of FIG. 1 comprises an outer metal casing 10 having a floor 11 and integral side walls 12. The metal casing 10 is first lined with a permanent lining of refractory brick 13 on which is located an expendable lining formed of slabs of heat insulating refractory material 14. The floor 11 contains outlets housing nozzles 15 each of which, according to the invention, is surrounded by an expendable sleeve of refractory heat insulating material 16.

Figure 2:
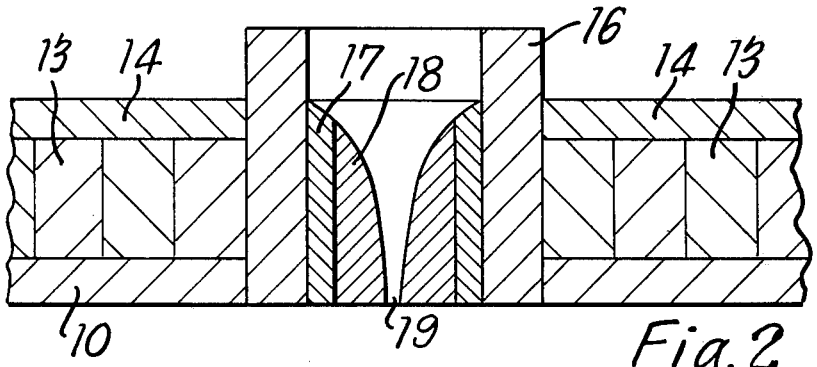
FIG. 2 is a partial sectional view, drawn to an enlarged scale, of the nozzle area of the tundish of FIG. 1.
Figure 3:
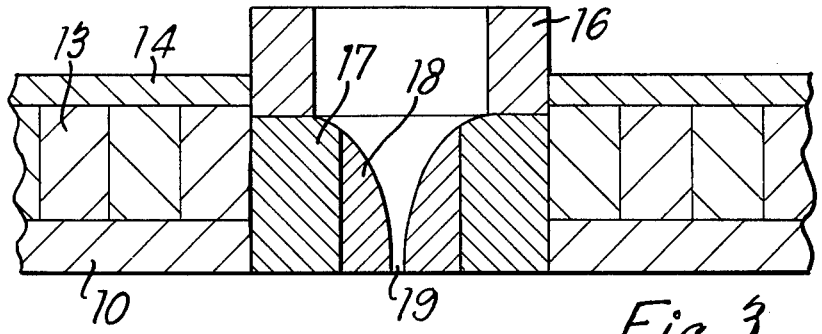
FIG. 3 is a view similar to FIG. 2 of an alternative construction.

As shown in FIG. 2, sleeve 16 extends from the bottom of the outlet for the nozzle 15 up beyond the lining 14, and the nozzle 15 is located within the outlet. The sleeve is dimensioned to extend about 25 to 35 mm above the lining 14. The nozzle 15 comprises an outer nozzle block 17 within which is located an inner nozzle block 18 which defines the nozzle passage 19. Both nozzle blocks are formed of refractory material. As shown in FIG. 3, the sleeve 16 is located on top of an outer nozzle block 17 which is set into the permanent refractory lining as a permanent fixture.

By way of example the sleeve 16 may be formed of a mixture of the following ingredients in parts by weight:

silica sand 40 to 45
silica flour 40 to 45
slag wool 2 to 6
resin binder 3 to 9
paper 2 to 6

To form a sleeve the above mixture is slurried with water and the aqueous slurry drawn onto a perforated former to define a tube, which is then dried and stoved in known manner. In an example the formed sleeve had a density of 1 to 1.2 g/cc.

In use, molten metal is poured into the tundish onto a pouring pad in the impact area, not shown, and out via the nozzles 15. The initial flow of metal tends to cool on the relatively cooler tundish floor and forms a thin skull below the level of the top of the sleeve 16. Succeeding molten metal flows over the thin skull and over the top of the sleeve 16 and thence into the nozzle 15. Since the metal skull is kept back from the nozzle by the sleeve 16 it is relatively easy to replace or repair nozzles.

The expendable partition of refractory material e.g. sleeve 16, may include an exothermic component which can introduce extra heat into the nozzle area.

We claim:

1. A tundish comprising a casing having a floor with at least one outlet nozzle located therein and upstanding sidewalls, the casing having a permanent refractory lining, and means for spacing any skull that is formed from at least one nozzle within the tundish and for minimizing extraneous material flow into the nozzle, said means comprising an expendable consumable continuous partition of refractory heat insulating material located adjacent the nozzle and dimensioned to stand proud of the adjacent portion of the tundish floor.

2. A tundish according to claim 1 wherein at least one nozzle is surrounded by said partition.

3. A tundish according to claim 1 wherein each partition surrounds a nozzle and comprises four walls.

4. A tundish according to claim 1 wherein each partition surrounds a nozzle and is an integral preformed sleeve.

5. A tundish according to claim 1 wherein each partition is made of a material comprising a major proportion of particulate refractory, a minor proportion of fibrous material and an organic binder.

6. A tundish according to claim 1 wherein each partition is made of a material comprising by weight 75 to 90% particulate refractory, up to 15% fibrous material, and up to 10% organic binder.

7. A tundish according to claim 1 wherein each partition is made of a material having a density of 0.8 to 1.5 g/cm$^3$ and a thermal conductivity of less than 0.0007 c.g.s. units.

8. A tundish according to claim 1 wherein each partition is made of a mixture of the following ingredients in parts by weight:

silica sand 40 to 45
silica flour 40 to 45
slag wool 2 to 6
resin binder 3 to 9
paper 2 to 6.

9. A tundish according to claim 1 wherein the casing has a further inner expendable lining for the sidewalls and floor, which in use contacts molten metal, comprising preformed slabs of refractory heat insulating material and the impact area of the tundish is lined additionally with a material selected from highly erosion resistant and sacrificial materials.

10. A method of continuously casting a metal in a tundish comprising the steps of providing a tundish having a casing floor with at least one outlet nozzle located therein and upstanding sidewalls, the casing having a permanent refractory lining and an expendable consumable partition of refractory heat insulating material located adjacent at least one nozzle within the tundish and standing proud of the adjacent portion of the tundish floor, pouring molten metal into the tundish so that a thin skull forms on the relatively cooler tundish floor below the top of said partition, molten metal flowing over the thin skull and the top of said partition to partially consume said partition, and replacing said partition after completion of each molten metal casting cycle.

* * * * *